US011057721B2

(12) United States Patent
El Guindi

(10) Patent No.: US 11,057,721 B2
(45) Date of Patent: Jul. 6, 2021

(54) OWN VOICE DETECTION IN HEARING INSTRUMENT DEVICES

(71) Applicant: Sonova AG, Staefa (CH)

(72) Inventor: Nadim El Guindi, Zurich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/164,714

(22) Filed: Oct. 18, 2018

(65) Prior Publication Data

US 2020/0128335 A1 Apr. 23, 2020

(51) Int. Cl.
*H04R 25/00* (2006.01)

(52) U.S. Cl.
CPC ..... *H04R 25/505* (2013.01); *H04R 25/405* (2013.01); *H04R 25/407* (2013.01); *H04R 2225/021* (2013.01); *H04R 2225/43* (2013.01)

(58) Field of Classification Search
CPC .. H04R 25/405; H04R 25/407; H04R 25/505; H04R 2225/021; H04R 2225/43
USPC ..... 381/312, 313, 317, 320, 321
See application file for complete search history.

(56) References Cited

U.S. PATENT DOCUMENTS 5,692,059 A * 11/1997 Kruger ..... H04R 1/1016 381/151
7,853,031 B2 12/2010 Hamacher
9,516,442 B1 12/2016 Dusan et al.
9,516,552 B2 12/2016 Dusan et al.
9,930,447 B1 * 3/2018 Termeulen ..... G10L 21/028
2016/0111113 A1 * 4/2016 Cho ..... H04R 1/326 704/250

FOREIGN PATENT DOCUMENTS

EP 1956589 12/2009
WO WO-2017016587 A1 * 2/2017 ..... H04R 3/005

* cited by examiner

*Primary Examiner* — Walter F Briney, III
(74) *Attorney, Agent, or Firm* — Knobbe, Martens, Olson & Bear, LLP

(57) ABSTRACT

According to some embodiments, a hearing device (e.g., a HI) configured to detect own voice comprises two or more microphones configured to detect a voice, and a motion detection device or component, wherein the hearing device is configured to determine the direction of arrival (DOA) of the voice detected by the microphones of the hearing device, wherein the hearing device is configured to determine whether there is movement of the hearing device using the motion detection device or component, and wherein, if it is determined that the DOA of the voice detected by the microphones of the hearing device is from the front of a user of the hearing device and said detected voice remains stable, and there is movement detected by the motion detection device or component, the hearing device is configured to conclude that the voice detected by the hearing device is own voice.

19 Claims, 3 Drawing Sheets

OWN VOICE DETECTION IN HEARING INSTRUMENT DEVICES

BACKGROUND

A person's perception of his or her own voice is an important performance criteria for hearing device (e.g., hearing instrument (HI)) users. Effects like occlusion or ampclusion lead to a different perception of the own voice. Therefore, it is important that the hearing device processes the own voice with a dedicated processing scheme which is optimized for a natural perception of the own voice. This requires a reliable detection of the presence of own voice of the hearing device user.

SUMMARY

According to some embodiments, a method of detecting own voice in a hearing device comprises detecting a voice using two or more microphones of a hearing device (e.g. a hearing instrument), determining the direction of arrival (DOA) of the voice detected by the hearing device, if it is determined that the DOA of the voice detected by the hearing device is from the front of a user of the hearing device, evaluating an additional criterion regarding the voice detected by the hearing device to determine if the additional criterion is indicative of own voice, and processing the voice detected by the hearing device as own voice if the DOA is from the front of the user of the hearing device, and the additional criterion is indicative of own voice.

According to some embodiments, a method of detecting own voice in a hearing system comprises detecting a voice using at least one microphone of at least one hearing device, the at least one hearing device being part of the hearing system, determining the direction of arrival (DOA) of the voice detected by the at least one hearing device, if it is determined that the DOA of the voice detected by the at least one hearing device is from the front of a user of the hearing system, evaluating at least one additional criterion regarding the voice detected by the at least one hearing device to determine if said at least one additional criterion is indicative of own voice, and processing the voice detected by the hearing device as own voice if the DOA is from the front of the user of the hearing system, and the at least one additional criterion is indicative of own voice.

According to some embodiments, determining the DOA of the voice detected by the hearing device or system comprises using two or more microphones in a single hearing device. In some embodiments, determining the DOA of the voice detected by the hearing device comprises using two or more microphones in two hearing devices.

According to some embodiments, the DOA is between 0 and 30 degrees (e.g., 0-1, 1-2, 2-3, 3-4, 4-5, 5-6, 6-7, 7-8, 8-9, 9-10, 10-15, 15-20, 20-25, 25-30, 0-5, 0-10, 0-30, 5-25, 10-20 degrees, angles between the foregoing ranges, etc.) relative to a forward-facing direction of a user of the hearing device or system (e.g., in order for the DOA of the voice detected by the hearing device to be from the front of the user). In some embodiments, the DOA is between 0 and 10 degrees relative to a forward-facing direction of a user of the hearing device or system (e.g., in order for the DOA of the voice detected by the hearing device to be from the front of the user).

According to some embodiments, the additional criterion comprises detecting movement of the hearing device. In some arrangements, the additional criterion comprises the DOA of the detected voice being stable. In some embodiments, the detected voice being stable comprises the DOA is maintained between 0 and 30 degrees (e.g., 0-1, 1-2, 2-3, 3-4, 4-5, 5-6, 6-7, 7-8, 8-9, 9-10, 10-15, 15-20, 20-25, 25-30, 0-5, 0-10, 5-25, 10-20 degrees, angles between the foregoing ranges, etc.) relative to a forward-facing direction of a user while the detected voice is detected by the hearing device or system.

According to some embodiments, the additional criterion comprises detecting movement of the hearing device, and the DOA of the detected voice being stable. In some embodiments, detecting movement of the hearing device comprises detecting movement using an accelerometer or another motion detection component or device of the hearing device.

According to some embodiments, a hearing device (e.g., a HI) configured to detect own voice comprises two or more microphones configured to detect a voice, and a motion detection device or component, wherein the hearing device is configured to determine the direction of arrival (DOA) of the voice detected by the microphones of the hearing device, wherein the hearing device is configured to determine whether there is movement of the hearing device using the motion detection device or component, and wherein, if it is determined that the DOA of the voice detected by the microphones of the hearing device is from the front of a user of the hearing device and said detected voice remains stable, and there is movement detected by the motion detection device or component, the hearing device is configured to conclude that the voice detected by the hearing device is own voice.

According to some embodiments, a hearing system configured to detect own voice comprises at least one hearing device, the at least one hearing device comprising at least one microphone configured to detect a voice, and at least one motion detection device or component. The hearing system is configured to determine the direction of arrival (DOA) of the voice detected by the at least one hearing device. Further, the hearing system is configured to determine whether there is movement of the at least one hearing device using the at least one motion detection device or component. In some embodiments, if it is determined that the DOA of the voice detected by the at least one hearing device is from the front of a user of the hearing system and said detected voice remains stable, and that there is movement detected by the at least one motion detection device or component, the hearing system is configured to conclude that the voice detected by the at least one hearing device is own voice.

According to some embodiments, the hearing device or system comprises a single hearing device configured to be worn only in one ear of a user, wherein the single hearing device comprises two or more microphones (e.g., 2, 3, 4, more than 4, etc.). In some embodiments, the hearing device or system comprises two hearing devices, each of the two hearing devices being configured to be worn in each ear of a user.

According to some embodiments, the motion detection device or component comprises an accelerometer. In other embodiments, the motion detection device or component does not include an accelerometer (e.g., includes a different motion detection device or component, such as, for example, a gyro sensor, an angular rate sensor, an angular velocity sensor, an inertial measurement unit, a basic motion sensor).

According to some embodiments, the DOA of the detected voice is from the front of a user of the hearing device or system when the DOA is between 0 and 30 degrees (e.g., 0-1, 1-2, 2-3, 3-4, 4-5, 5-6, 6-7, 7-8, 8-9, 9-10, 10-15, 15-20, 20-25, 25-30, 0-5, 0-10, 0-30, 5-25, 10-20 degrees, angles between the foregoing ranges, etc.) relative to a forward-facing direction of a user of the hearing device or system. In some embodiments, the DOA of the detected voice is from the front of a user of the hearing device or system when the DOA is between 0 and 10 degrees relative to a forward-facing direction of a user of the hearing system (e.g., HI).

According to some embodiments, the hearing device is a behind-the-ear (BTE) hearing device. In some embodiments, the hearing device is not a BTE hearing device (e.g., receiving-in-the-ear (RITE), in-the-ear (ITE), in-the-canal (ITC), completely-in-the-canal (CIC)).

According to some embodiments, the detected voice remains stable when the DOA of said detected voice is maintained between 0 and 30 degrees relative to the forward-facing direction of a user of the hearing device while the detected voice is detected by the hearing device.

According to some embodiments, a hearing device (e.g., HI) configured to detect own voice comprises two or more microphones configured to detect a voice, and a motion detection device or component. In some embodiments, the hearing device is configured to determine the direction of arrival (DOA) of the voice detected by the microphones. The hearing device is configured to determine whether there is movement of the hearing device using the motion detection device or component. In some embodiments, if it is determined that the DOA of the voice detected by the hearing device is from the front of a user of the hearing device, and that there is movement detected by the motion detection device or component, the hearing device is configured to conclude that the voice detected by the hearing device is own voice.

According to some embodiments, the motion detection device or component comprises an accelerometer. In other embodiments, the motion detection device or component does not include an accelerometer (e.g., includes a different motion detection device or component, such as, for example, a gyro sensor, an angular rate sensor, an angular velocity sensor, an inertial measurement unit, a basic motion sensor).

BRIEF DESCRIPTION OF THE DRAWINGS

These and other features, aspects and advantages of the present application are described with reference to drawings of certain embodiments, which are intended to illustrate, but not to limit, the concepts disclosed herein. The attached drawings are provided for the purpose of illustrating concepts of at least some of the embodiments disclosed herein and may not be to scale.

DETAILED DESCRIPTION

Devices, systems and methods have been invented that assist in detecting and subsequently processing own voice from a user of a hearing device (e.g., a hearing instrument (HI)). In some arrangements, the embodiments that facilitate in detecting a user's own voice are accomplished in a predictable, reliable and cost-effective manner. Certain benefits are associated with the various embodiments described herein, including, but not limited to, providing for own-voice detection without the need to use more complicated and more expensive devices (e.g., bone conduction sensors or sensors in the ear canal), modifying existing hearing device designs and at a relatively low price to provide for more accurate and more consistent and reliable detection of own voice, and other benefits and advantages.

Own voice perception is an important performance criterion for the hearing device (e.g., HI) user, and reliable detection of own voice provides benefits in many instances (e.g., telephone use cases, other conversational contexts, and the like). Once own voice is detected by a HI or other hearing device, the associated voice/sound data that are received (e.g., via one or more microphones) are processed differently than other sound (e.g., speech that is not the user's, other types of sounds, etc.). Certain inherent effects associated with hearing devices can complicate the detection and processing of own voice. For instance, effects like occlusion or ampclusion can lead to a different perception of the own voice. To date, certain solutions associated to own voice detection have been directed to the use of bone conduction sensors or sensors in the ear canal. However, such solutions tend to be relatively complex and require additional components or devices. Thus, the devices, systems and methods described herein can create a more accurate, comfortable, reliable, effective and efficient hearing device experience for a user. Further, because the own voice detection embodiments disclosed herein are relatively simple and avoid components and designs that are costly, designs that incorporate such own voice detection technologies can be attractive to manufacturers and consumers of hearing device or hearing systems from a price point perspective.

Figure 1:
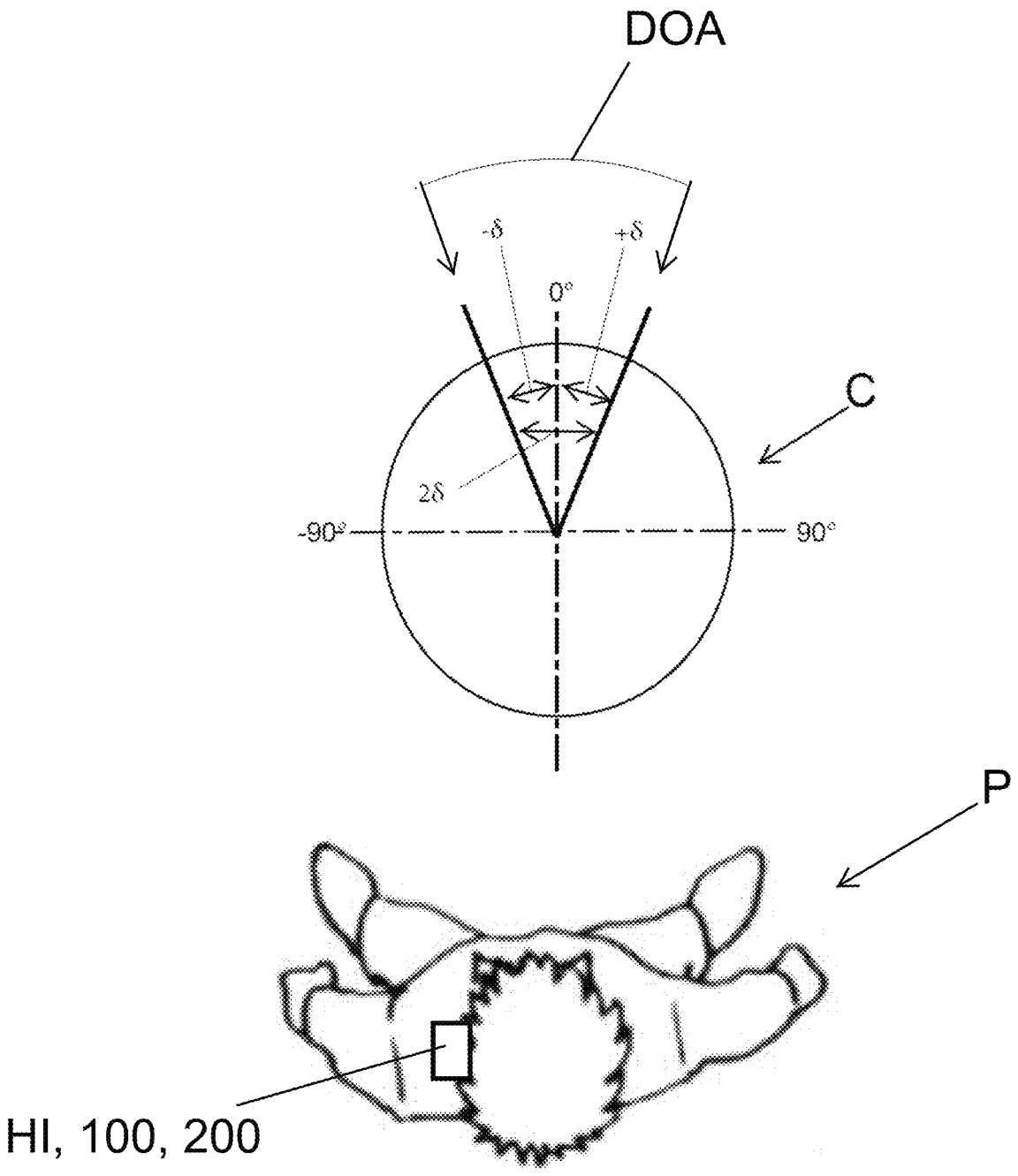
FIG. 1 illustrates one embodiment of a hearing device worn by a user and an arrow schematically depicting a Direction of Arrival (DOA) estimation for speech being directed toward the user.

As illustrated schematically in FIG. 1, a user can wear a hearing device (e.g., HI) to enhance his or her hearing. In some embodiments, the hearing device configuration or design is monaural (e.g., having a single HI or other hearing device that is positioned in only one ear of the user). However, in other arrangements, the hearing device configuration is binaural (e.g., having HIs or other hearing devices that are configured to be positioned on/in both ears of the user). The various inventions disclosed herein can be incorporated into any monaural or binaural hearing device (e.g., HI) configuration, as desired or required.

According to some embodiments, the hearing devices or systems that incorporate the own voice detection and processing technology described herein can include a variety of types or designs, including, without limitation, behind-the-ear (BTE), receiving-in-the-ear (RITE), in-the-ear (ITE), in-the-canal (ITC), completely-in-the-canal (CIC) and the like. As used herein, hearing device is a broad term and includes any device or system that is configured to provide audio to a user. In some implementations, the hearing device provides processed audio to compensate for or otherwise assist with a user's hearing impairment. In other embodiments, the hearing device provides audio without compensating for hearing impairment of the user (e.g., the hearing device provides audio to someone who does not have hearing impairment or to someone who is not using the device for hearing impairment purposes). In some embodiments, any existing or new hearing device design can be retrofitted or otherwise modified to include the disclosed own voice technology features.

During use of a hearing device or system, the direction of arrival (DOA) of voice or other sound toward the user to the device or system can vary. For example, in the embodiment schematically illustrated in FIG. 1, the DOA is directly in front of the user P. According to the directional compass C provided in FIG. 1, the depicted DOA is 0 degrees or nearly identical to 0 degrees (e.g., relative to the forward-facing direction of a user of the hearing device or the axis directly perpendicular or orthogonal to the user P).

In some embodiments, the DOA of a voice or other sound perceived by the hearing device or system, and thus the user P, originates and is directed from the front of the user P. In other words, the DOA is 0±δ degrees, where δ is an acceptable angle for a particular hearing device design as being indicative of voice coming from the "front" of the user. For example, in some embodiments, DOA from the "front" of the user means that δ is 0 to 30 degrees (e.g., 0-1, 1-2, 2-3, 3-4, 4-5, 5-6, 6-7, 7-8, 8-9, 9-10, 10-15, 15-20, 20-25, 25-30, 0-5, 0-10, 0-30, 5-25, 10-20 degrees, angles between the foregoing ranges, etc.). In some embodiments, DOA from the "front" means that δ is greater than 30 degrees (e.g., 30-35, 35-40, 40-45 degrees, angles between the foregoing ranges, greater than 45 degrees, etc.), as desired or required. With continued reference to the directional compass C of FIG. 1, the angle can vary within a certain minus and plus range +δ, −δ (e.g., relative to the orthogonal or perpendicular direction relative to the user, which is shown as the 0 degree line in FIG. 1).

In some embodiments, if the voice or other sound that is detected by the hearing device or system is outside of the target angle range that will qualify such voice or other sound as originating from the "front" of the user, the voice or other sound will be deemed non-own voice and processed accordingly. Thus, in some configurations, once it is determined that the existence of such a criterion or prerequisite related to own voice detection does not exist, the processing of voice or other sound by the hearing device or system defaults to one or more other signal processing algorithms or protocols.

Figure 2:
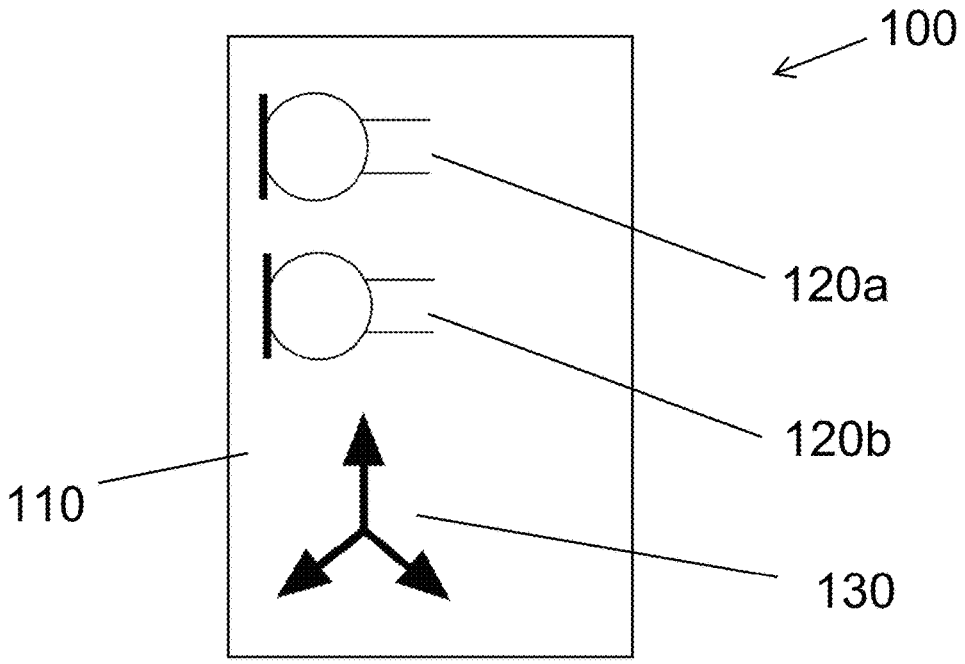
FIG. 2 schematically illustrates a monaural hearing device configuration according to one embodiment.

As illustrated in FIG. 2, in some embodiments, a hearing device or system 100 can include a monaural design, meaning that it comprises only a single hearing device 110 that is positioned on, in or near a user's left or right ear (not shown). Alternatively, however, as discussed below with reference to FIG. 3, a hearing device or system 200 can include a binaural design that comprises two hearing devices 210, 212. In such arrangements, each hearing device 210, 212 is adapted to be placed on, in or near the user's left and right ears.

With continued reference to FIG. 2, the hearing device 110 can include two microphones 120*a*, 120*b* for detecting voice and other sound. The microphones can be of any type suitable for a hearing device, such as, for example and without limitation, electret microphones, MEMS microphones, sound velocity sensors, PU sensors (e.g., sound pressure/velocity sensors), condenser microphones, dynamic microphones or the like. In other arrangements, a hearing device 110 can include fewer (e.g., 1) or more (e.g., 3, 4, 5, more than 5, etc.) microphones, as desired or required for a particular application or use.

The hearing device 110 of the hearing system can also include one or more motion detection components or devices 130. In some embodiments, such a motion detection component or device 130 comprises an accelerometer. However, in other configurations, the motion detection component or device includes a different type of component or device, such as, for example, a gyro sensor, an angular rate sensor, an angular velocity sensor, an inertial measurement unit, a basic motion sensor and/or the like, either in addition to or in lieu of an accelerometer.

Figure 3:
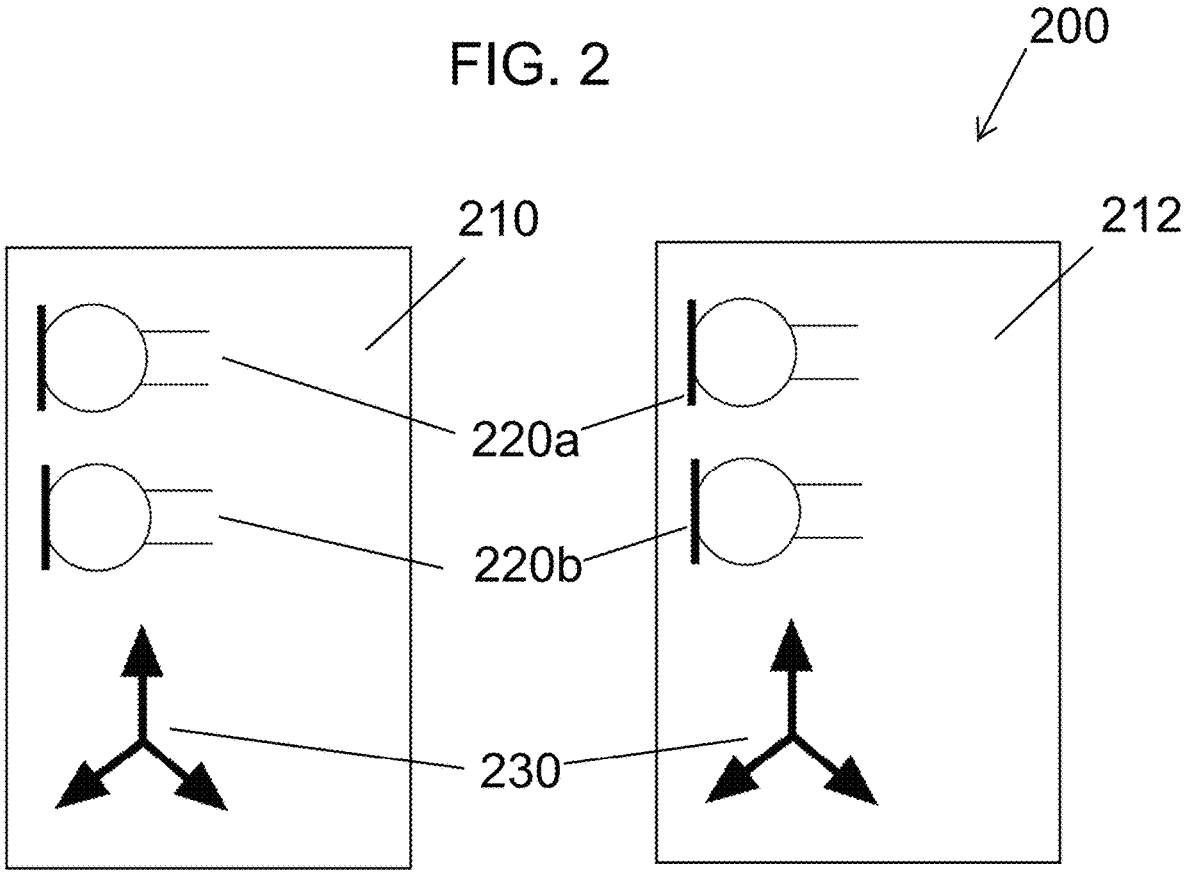
FIG. 3 schematically illustrates a binaural hearing device configuration according to one embodiment.

In other configurations, as depicted in FIG. 3, the various inventions and features described herein can be incorporated into a binaural hearing device design 200 that includes two hearing devices 210, 212, one for each of the user's ears. As with the monaural configuration illustrated in FIG. 2, each of the hearing devices 210, 212 of a binaural system or design 200 can include one or more (e.g., two) microphones 220*a*, 220*b* and a motion detection component or devices 230 (e.g., an accelerometer).

For any of the embodiments disclosed herein, the hearing device microphones 120*a*, 120*b*, 220*a*, 220*b* can include any type of microphone. In some configurations, the microphones comprise electret microphones, MEMS microphones, sound velocity sensors, PU sensors (e.g., sound pressure/velocity sensors), condenser microphones, dynamic microphones or the like. However, in other arrangements, any other type of microphone or voice/sound receiving device or component can be used.

Regardless of the exact type of hearing device design that is used, the hearing device or system can include any additional components, devices and/or features, as desired or required. For example, the hearing device that incorporates the own voice recognition technology described herein can include one or more of the following: a microphone, a motion detection device (e.g., accelerometer), an amplifier, a processor, a switch, button or other controller, a housing, a battery, tubing, an ear hook, an earmold, other fastening, mechanical or other securement features, components or devices and/or the like.

As noted above, for any of the embodiments disclosed herein, a hearing device (e.g., HI) 110, 210 can include one of a variety of hearing device types or designs, including, without limitation, behind-the-ear (BTE), receiving-in-the-ear (RITE), in-the-ear (ITE), in-the-canal (ITC), completely-in-the-canal (CIC) and the like. Thus, any type of hearing device or system (e.g., a HI) can be manufactured with the own voice detection and processing features described herein.

Figure 4:
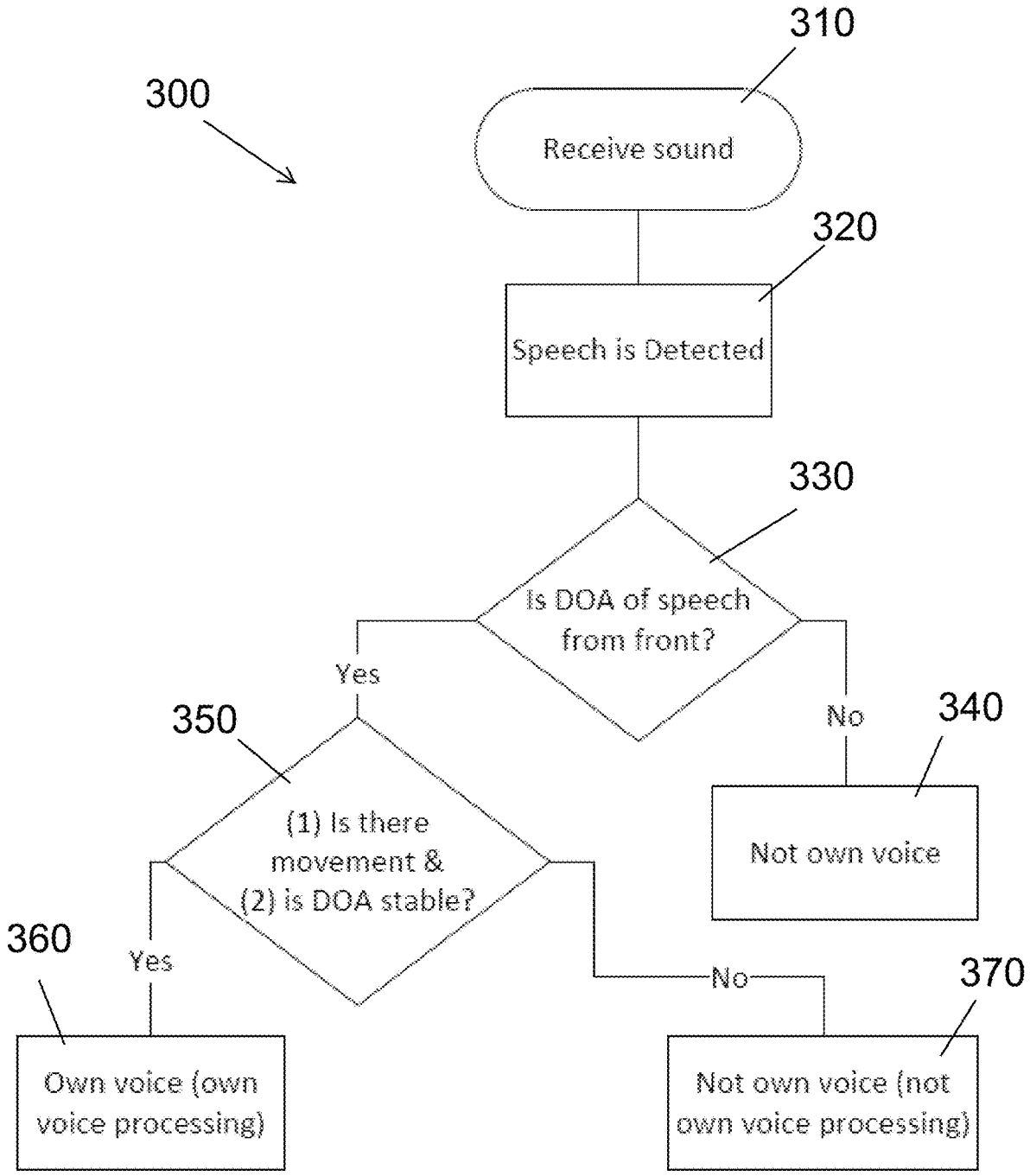
FIG. 4 illustrates a flow chart for determining whether voice detected by a hearing device should be processed as own voice according to one embodiment.

FIG. 4 illustrates a flowchart of one embodiment 300 for detecting own voice by a hearing device or system. As noted herein, the methods and associated devices that incorporate such own voice detection technologies can be used with any hearing device configuration or design.

With reference to FIG. 3, the own voice detection protocol or method 310 is initiated when voice or other sound is detected by a hearing device or system 320. The hearing device or system can comprise a monaural or a binaural design, as required or desired by a particular application or use. In some embodiments, when a monaural design is used (e.g., when a HI or other hearing device is positioned relative to only one ear of the user), voice or other sound is detected by two microphones 120*a*, 120*b* of the hearing device 110 (see, e.g., FIG. 2). However, as noted above, a HI or other hearing device can have fewer than 2 microphones (e.g., 1 microphone) or greater than 2 microphones (e.g., 3, 4, more than 4 microphones). In such a configuration, the microphone(s) of the hearing device can be configured to detect the direction of arrival (DOA) of any detected voice or other sound. For example, the microphone(s) of the hearing device (e.g., HI) can have sensors, the necessary signal processing and/or any other device, component or feature that facilitates determining the DOA within some desired level of confidence. In some embodiments, the DOA is determined in the main processor of the hearing device (e.g., HI). In some embodiments, the DOA is determined in a preprocessor that may be part of a microphone chip (e.g., a MEMS microphone chip).

In binaural embodiments, the detection of DOA of can be determined by comparing voice or other sound signals that are received by the left and right hearing devices (e.g., HIs). For example, in some configurations, when the sound intensity of voice or other sound detected by the microphone(s) of the left hearing device (e.g., HI) is similar (e.g., within a particular decibel range) to the sound intensity of voice or other sound detected by the microphone(s) of the right hearing device (e.g., HI), the device or system can be configured to determine or otherwise estimate or conclude that the detected voice or other sound is coming from the "front" of the hearing device user. In other words, under such circumstances, the hearing device or system can be configured to determine that the DOA is from the "front" of the user.

As discussed above with reference to FIG. 1, a determination of whether voice or other sound is from the "front" of the hearing device (e.g., HI) user can depend on the particular angle δ of such voice or other sound that is detected, calculated, approximated or otherwise determined by the system 100, 200. In other embodiments, no specific angle δ is ever calculated or factored into a DOA determination or estimation. Rather, a conclusion that the DOA is from the "front" can be made by the system when one or more criteria are satisfied.

For example, such a conclusion can be reached when the acoustic or sound intensity (and/or another acoustic characteristic, e.g., phase, pitch, loudness, duration, texture, etc.) of the voice or other sound detected by the left and right hearing devices (HIs) of a hearing system (e.g., a HI system) are similar (e.g., within a particular range) and/or if the coherence between the left and right signal is high. According to some embodiments, for example, a conclusion of DOA being from the front can be reached with the intensity of voice or other sounds detected by the left and right HI devices of a HI system are within 0-10% of one another (e.g., 0-1, 1-2, 2-3, 3-4, 4-5, 5-6, 6-7, 7-8, 8-9, 9-10, 3-7, 2-8, 0-2, 0-3, 0-4, 0-5%, percentages between the foregoing ranges, etc.). Similar comparisons with one or more other acoustic properties can be made, either in lieu of or in addition to intensity, to help the HI system determine when the DOA is from the "front" in a binaural configuration.

In other embodiments, a hearing device or system can be configured to determine or otherwise estimate the DOA of detected voice or other sound without comparing properties of sound detected by left and right hearing devices of a binaural system. In arrangements where a hearing device includes two or more microphones, such as those schematically illustrated and discussed herein with reference to FIGS. 2 and 3, a comparison of one or more acoustic properties (e.g., intensity, phase, pitch, loudness, duration, texture, etc.) between the different microphones of the hearing device (e.g., HI) can be used to determine or estimate whether the DOA is from the front.

With continued reference to FIG. 4, regardless of the exact manner that it is accomplished, the hearing device or system can be configured to determine whether the DOA of a detected voice or other sound is from the "front" of the hearing device user 330. If the HI or other hearing device or system determines that the DOA is not from the "front" of the user, the device or system can conclude that the detected voice or other sound is not own voice 340. Accordingly, such a voice or other sound can be processed as non-own voice.

However, if the device or system determines that the detected voice or other sound is from the "front" (e.g., the DOA of the detected voice or other sound is from the "front"), the detected voice or other sound is analyzed further by the device or system to determine if it is indeed the user's own voice. In some embodiments, in order to be deemed as own voice, the detected voice or other sound detected by the device or system needs to satisfy one or more other criteria. For example, as depicted in the arrangement of FIG. 4, the device or system will determine (1) if there is movement by the user, and (2) if the DOA of the voice or other sound is stable while it is being detected by the hearing device or system 350.

In some arrangements, movement of the hearing device user's head suggests that the user is talking, which is also indicative of own voice. Typically, when people talk, movement generated by their mouth and jaw creates movement along their entire head. In some embodiments, one or more of the hearing devices (e.g., HIs) included in a hearing device design (e.g., depending on whether the hearing device or system comprises a monaural or a binaural design) can include a motion detection device, component or other feature 130, 230 (FIGS. 2 and 3). Such a motion detection device, component or other feature 130, 230 can include one or more accelerometers. However, in other embodiments, the motion detection technology can include something other than an accelerometer, such as, for instance, a gyro sensor, an angular rate sensor, an angular velocity sensor, an inertial measurement unit, a basic motion sensor and/or the like.

As noted above with reference to FIGS. 2 and 3, the accelerometer or other motion detection device, component or feature 130, 230 can be included within a hearing device (e.g., HI). The sensitivity of such a motion detection device can be selected in accordance with a desired or required minimum threshold that indicates threshold movement by the hearing device user indicative of "talking" motion. In some embodiments, the sensitivity of the motion detection device can be adjusted (e.g., by the manufacturer, by the user, etc.) in order to customize the design of the device or system, as desired or required.

With continued reference to the follow-up assessment indicated by 350 in the own voice identification embodiment illustrated by the flow chart of FIG. 4, even when the requisite level of motion has been detected by an accelerometer or other motion detection device, component or feature in the hearing device, the hearing device may still need to confirm one or more other criteria before a determination is made that the detected voice or other sound is own voice. For example, in some arrangements, such a criterion can include whether the DOA of the detected voice or sound is "stable." Stable can generally mean that the DOA does not change within a certain degree.

In some embodiments, a "stable" DOA is one where the DOA angle relative to the forward-facing direction of a user or the direction orthogonal to the HI or other hearing device user (e.g., angle δ in FIG. 1) is maintained within a particular range over a particular time period. In one arrangement, in order for the "stable" criterion to be met, the range for the DOA angle is 0 to 30 degrees (e.g., 0-1, 1-2, 2-3, 3-4, 4-5, 5-6, 6-7, 7-8, 8-9, 9-10, 10-15, 15-20, 20-25, 25-30, 0-5, 0-10, 5-25, 10-20 degrees, angles between the foregoing ranges, etc.), while the time period is the time period that the perceived voice or other sound is being detected by the hearing device or system. In other embodiments, however, the duration is a minimum time period after voice or other sound is detected, such as, for example, between 0 and 60 seconds (e.g., 0-5, 0-10, 0-20, 0-30, 0-40, 0-50, 0-60 seconds, time durations between the foregoing ranges, etc.) after voice or other sound is detected by the hearing device or system.

In some embodiments, in order to distinguish between the voice or other sound that is being evaluated as possible own voice and other sounds that are detected by the hearing device or system, the device or system is configured to distinguish the initially perceived voice or other sound from other voices or sounds based on one or more factors or properties. For example, the hearing device (e.g., HI) can be adapted to identify the initially-identified voice or other sound (e.g., relative to other detected voices or sounds) based on pitch, loudness, duration, texture and/or any other acoustic characteristic. Thus, even if other voices or other sounds are detected by the hearing device or system (e.g., a HI), the device or system can be advantageously designed and configured to evaluate the initially-detected voice or sound for purposes of own voice determination (e.g., in accordance with certain criteria, such as those in 350 of the method depicted in FIG. 4).

With further attention to FIG. 4, if one or more additional criteria are satisfied (e.g., as discussed above with reference to inquiries 350) are satisfied, the hearing device or system can be configured to conclude that the detected voice or other sound is indeed own voice 360. Accordingly, the detected voice or other sound can be processed accordingly (e.g., with signal processing intended for own voice). On the other hand, if one or more criteria are not satisfied, the hearing device or system (e.g., a HI) can be configured to conclude that the detected voice or other sound is not own voice 370. As a result, the voice or other sound will be processed accordingly.

According to some embodiments, the present application discloses devices, systems and/or methods that include one or more of the following features: a hearing device and internal and external components or devices of such a hearing device, including, without limitation, a microphone, a motion detection device (e.g., accelerometer), an amplifier, a processor, a switch, button or other controller, a housing, a battery, tubing, an ear hook, an earmold, other fastening, mechanical or other securement features, components or devices and/or the like.

Several embodiments of the invention are particularly advantageous because they include one, several or all of the following benefits: (i) provides the ability to accurately determine whether voice detected by a hearing device or system is indeed own voice, (ii) reduces the complexity of a hearing device, (iii) permits the determination of own voice without the need to include more complicated devices or components, e.g., bone conduction sensors or sensors in the ear canal, (iv) allows for improved own voice detection that overcomes occlusion or ampclusion effects; (v) allows for the technology to be incorporated into commercially available hearing devices or systems (e.g., HIs); and (vi) provides for more comfortable and more reliable hearing devices and systems.

Any methods described herein may be embodied in, and partially or fully automated via, software code modules executed by one or more processors or other computing devices. The methods may be executed on the computing devices in response to execution of software instructions or other executable code read from a tangible computer readable medium. A tangible computer readable medium is a data storage device that can store data that is readable by a computer system. Examples of computer readable mediums include read-only memory, random-access memory, other volatile or non-volatile memory devices, CD-ROMs, magnetic tape, flash drives, and optical data storage devices.

In addition, embodiments may be implemented as computer-executable instructions stored in one or more tangible computer storage media. As will be appreciated by a person of ordinary skill in the art, such computer-executable instructions stored in tangible computer storage media define specific functions to be performed by computer hardware such as computer processors. In general, in such an implementation, the computer-executable instructions are loaded into memory accessible by one or more computer processors. The computer processor then executes the instructions, causing computer hardware to perform the specific functions defined by the computer-executable instructions. As will be appreciated by a person of ordinary skill in the art, computer execution of computer-executable instructions is equivalent to the performance of the same functions by electronic hardware that includes hardware circuits that are hardwired to perform the specific functions. As such, while embodiments illustrated herein are typically implemented as some combination of computer hardware and computer-executable instructions, the embodiments illustrated herein could also be implemented as one or more electronic circuits hardwired to perform the specific functions illustrated herein.

Although several embodiments and examples are disclosed herein, the present application extends beyond the specifically disclosed embodiments to other alternative embodiments and/or uses of the inventions and modifications and equivalents thereof. It is also contemplated that various combinations or subcombinations of the specific features and aspects of the embodiments may be made and still fall within the scope of the inventions. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

While the embodiments disclosed herein are susceptible to various modifications, and alternative forms, specific examples thereof have been shown in the drawings and are herein described in detail. It should be understood, however, that the inventions are not to be limited to the particular forms or methods disclosed, but, to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers. For example, "about 10 mm" includes "10 mm." Terms or phrases preceded by a term such as "substantially" include the recited term or phrase. For example, "substantially parallel" includes "parallel."

What is claimed is:

1. A method of detecting own voice in a hearing device, the method comprising:

detecting a voice using two or more microphones of a hearing device;

determining the direction of arrival (DOA) of the voice detected by the hearing device;

if it is determined that the DOA of the voice detected by the hearing device is from the front of a user of the hearing device, evaluating an additional criterion regarding the voice detected by the hearing device to determine if the additional criterion is indicative of own voice, wherein the additional criterion is configured to be detected by the hearing device, wherein the additional criterion comprises detecting movement of the hearing device indicative of movement of the head of the user; and processing the voice detected by the hearing device as own voice if (1) the DOA is from the front of the user of the hearing device, and (2) the additional criterion is indicative of own voice.

2. The method of claim 1, wherein determining the DOA of the voice detected by the hearing device comprises using two or more microphones in a single hearing device.

3. The method of claim 1, wherein determining the DOA of the voice detected by the hearing device comprises using two or more microphones positioned in two hearing devices.

4. The method of claim 1, wherein the DOA is between 0 and 30 degrees relative to a forward-facing direction of a user of the hearing device.

5. The method of claim 1, wherein the DOA is between 0 and 10 degrees relative to a forward-facing direction of a user of the hearing device.

6. The method of claim 1, wherein the additional criterion comprises the DOA of the detected voice being stable.

7. The method of claim 6, wherein the detected voice being stable comprises the DOA is maintained between 0 and 30 degrees while the detected voice is detected by the hearing device.

8. The method of claim 1, wherein the additional criterion comprises (1) detecting movement of the hearing device, and (2) the DOA of the detected voice being stable.

9. The method of claim 1, wherein detecting movement of the hearing device comprises detecting movement using an accelerometer or another motion detection component or device of the hearing device.

10. A hearing device configured to detect own voice, the device comprising:

two or more microphones configured to detect a voice; and a motion detection device or component, wherein the two or more microphones and the motion detection device or component are included in a housing of the hearing device;

wherein the hearing device is configured to determine the direction of arrival (DOA) of the voice detected by the microphones of the hearing device;

wherein the hearing device is configured to determine whether there is movement of the hearing device using the motion detection device or component indicative of movement of a head of a user; and wherein, if it is determined that (1) the DOA of the voice detected by the microphones of the hearing device is from the front of a user of the hearing device and said detected voice remains stable, and (2) there is movement detected by the motion detection device or component, the hearing device is configured to conclude that the voice detected by the hearing device is own voice.

11. The system of claim 10, wherein the hearing device comprises a single hearing device configured to be worn only in one ear of a user, wherein the single hearing device comprises the two or more microphones.

12. The system of claim 10, wherein the hearing device comprises two hearing devices, each of said two hearing devices being configured to be worn in each ear of a user and each of said two hearing devices comprising one or more microphones.

13. The system of claim 10, wherein the motion detection device or component comprises an accelerometer.

14. The system of claim 10, wherein the DOA of the detected voice is from the front of a user of the hearing device when the DOA is between 0 and 30 degrees relative to a forward-facing direction of a user of the hearing device.

15. The system of claim 10, wherein the DOA of the detected voice is from the front of a user of the hearing device when the DOA is between 0 and 10 degrees relative to a forward-facing direction of a user of the hearing device.

16. The system of claim 10, wherein the hearing device is a behind-the-ear (BTE) hearing device.

17. The system of claim 10, wherein the detected voice remains stable when the DOA of said detected voice is maintained between 0 and 30 degrees relative to a forward-facing direction of a user of the hearing device while the detected voice is detected by the hearing device.

18. A hearing device configured to detect own voice, the device comprising:

two or more microphones configured to detect a voice; and a motion detection device or component;

wherein the two or more microphones and the motion detection device or component are included as part of the hearing device;

wherein the hearing device is configured to determine the direction of arrival (DOA) of the voice detected by the two or more microphones;

wherein the hearing device is configured to determine whether there is movement of the hearing device using the motion detection device or component, wherein determining whether there is movement of the hearing device comprises determining whether there is movement of a head of a user; and wherein, if it is determined that (1) the DOA of the voice detected by the hearing device is from the front of a user of the hearing device, and (2) there is movement detected by the motion detection device or component, the hearing device is configured to conclude that the voice detected by the hearing device is own voice.

19. The device of claim 18, wherein the motion detection device or component comprises an accelerometer.

* * * * *